United States Patent [19]

Adams

[11] Patent Number: 4,846,354

[45] Date of Patent: Jul. 11, 1989

[54] DISPLAY RACK

[75] Inventor: Dudley D. Adams, Yucaipa, Calif.

[73] Assignee: ADCO Enterprises Inc., Yucaipa, Calif.

[21] Appl. No.: 168,919

[22] Filed: Mar. 16, 1988

[51] Int. Cl.[4] ..... A47F 5/08

[52] U.S. Cl. ..... 211/41; 211/94; 211/103; 248/297.2; 248/222.3

[58] Field of Search ..... 211/94, 162, 41, 103, 211/94, 94.5; 248/222.3, 295.1, 297.2

[56] References Cited

U.S. PATENT DOCUMENTS

| | | | |
|---|---|---|---|
| 2,271,250 | 1/1942 | Buchholz | 248/222.3 X |
| 2,285,632 | 6/1942 | Orbain | 211/94.5 X |
| 4,192,424 | 3/1980 | Allsop | 248/297.2 X |
| 4,306,661 | 12/1981 | Allsop | 248/297.2 X |
| 4,635,801 | 1/1987 | Oren | 211/94 X |

FOREIGN PATENT DOCUMENTS

| | | | |
|---|---|---|---|
| 1217503 | 12/1970 | United Kingdom | 248/222.3 |

*Primary Examiner*—Robert W. Gibson, Jr.
*Attorney, Agent, or Firm*—Herb Boswell

[57] ABSTRACT

A display rack for video tapes is formed of an elongated support member which is located vertically on a support surface and one or more brackets which are attached to the support member. The brackets have opposed radiused edges allowing for twisting of the brackets onto the support member to lock the edges of the brackets underneath the lips on the support member.

20 Claims, 2 Drawing Sheets

DISPLAY RACK

BACKGROUND OF THE INVENTION

This invention is directed to an improved display rack for video tapes, video tape containers and other structures wherein the improved display rack of the invention utilizes brackets which can be attached to a support member by twisting the bracket onto the support member.

With the increased availability of video recording devices the displaying and renting of video tapes for viewing on these devices has become a very widespread industry. Many types of commercial establishments display and rent video tapes. Because floor space is normally of a premium in commercial establishments it is important that display racks for video tapes be as compact as possible while still allowing for the display of the video tape in a manner wherein the patron of the establishment may readily view the outside of the video tape to ascertain the contents of what is on the tape.

In displaying the tape for the consumers selection, normally the tape is located in a container which includes pictorial and written information concerning the contents of the tape. It is normally this container with or without the tape inside which is displayed to the consumers.

In the past either a book shelf like display rack has been utilized which only allows for displaying of the side edge of the video tape container or a magazine type rack has been utilized allows for a full frontal display of the front of the video tape container. While the bookshelf type rack achieves high density of tapes in a limited area, only a limited amount of the outside surface of the container is available for viewing by the viewing public to select a tape. With a magazine type display rack the full front or back surface of the container is available to the consumer, however, the number of video tapes which may be displayed in a particular display area is limited.

In U.S. Pat. No. 4,584,950 dated Apr. 29, 1986 and entitled Display Rack, myself and my co-inventors of U.S. Pat. No. 4,584,950 disclosed a display rack for video tapes and/or containers for video tapes which allow for increased density of the display of the video tapes while still allowing for viewing of a significant portion of the outside surface of the container of each of the video tape containers.

While the display rack of my and my co-inventors prior patent allows for increases in the density of video tapes or video tape containers which can be displayed in an particular display area, in certain installations wherein the supporting channel member of the rack extends from floor to ceiling or between other similar top and bottom type structures, the number of brackets which can be attached to a channel becomes fixed once the channel is fixed to the support structure. This is because upon attaching a floor to ceiling extending supporting channel member to its support structure, the floor and ceiling of the support structure interfer with access to the ends of the channel member. Once the ends of the channel member are no longer accessible, no further brackets can be added to the channel member because the brackets are attached to the channel member by sliding the brackets on one of the ends of the channel member.

BRIEF DESCRIPTION OF THE INVENTION

In view of the above it is evident that there exist a need for new and improved display racks wherein the display rack holding brackets can be attached to a support member or support channel without having to attach the brackets on the support member by sliding the brackets onto the ends of the support channel.

It is therefore a broad object of this invention to provide for new and improved display racks which can hold video tapes or other display items and wherein the display rack brackets can be added or removed from the display rack supporting member anywhere along the length of the support member. It is a further object of this invention to provide for new and improved display racks brackets which can be utilized with existing support structures and which are capable of locking and holding onto these existing support members.

These and other object as will be evident from the remainder of this specification are achieved in a display rack wherein the rack bracket is formed with a base plate having a plurality of ridges extending along the back of the base plate and left and right side edges sized and shaped to be positionable underneath lips or channels on the rack support members. The opposing corners of said back plate of the bracket are formed with radiuses, that is they are rounded. This allows for rotation of the backplate of the bracket underneath the lips or channels of the support member to attach the bracket to the support member.

The bracket further includes means on said bracket for holding an article. The rack support member is formed as an elongated element with left and right side lips and a plurality of ridges extending along the length of the elongated element. For holding the bracket in a fixed position on the support member after the bracket is attached to the support member, the ridges on the bracket back plate form an interference fit with the ridges on the support member.

BRIEF DESCRIPTION OF THE DRAWINGS INVENTION

This invention will be better understood when taken in conjunction with this specification and the drawings wherein.

Figure 1:
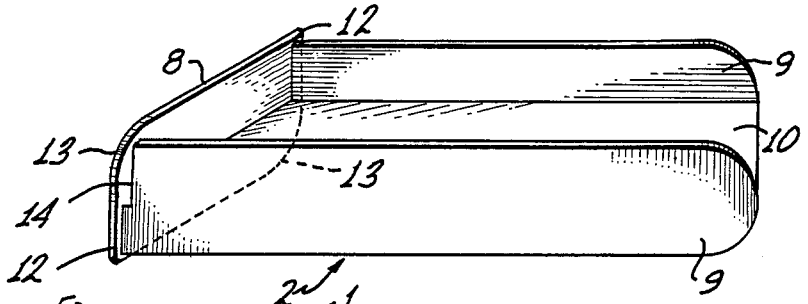
FIG. 1 is an isometric view of a first bracket of the invention.

The invention described in this specification and shown in the drawings utilizes certain principles and/or concepts as are set forth in the claims appended hereto. Those skilled in the display arts will realize that these principles and/or concepts are capable of being illustrated in a variety of embodiments which may differ from the exact embodiments utilized for illustrative purposes herein. For this reason this invention is not to be construed as being limited solely to the illustrative embodiments but is only to be construed in view of the claims.

DESCRIPTION OF THE ILLUSTRATIVE EMBODIMENTS

The improved rack of the invention for video tapes is of the typed composed of two main components, a support member and a plurality of brackets which attach to this support member.

As per the teachings of my above referenced U.S. Pat. No. 4,584,950, the contents of which are hereby incorporated by reference, by positioning a plurality of support members in a horizontal orientation in a side by side manner on a wall, and attaching a number of the brackets to the support members a complete rack system can be assembled on a wall, support board, post or other structure. Each individual support member serves as a foundation for a plurality of bracket members which are spaced along the vertical height of the support member in a spaced array. A video tape or video tape container is located in between an upper and a lower support member and can be easily removed and reinserted onto the support members by a consumer as the consumer casually and leisurely sorts through a plurality of video tapes or video tape containers which are supported on the improved video tape racks of the invention.

Figure 2:
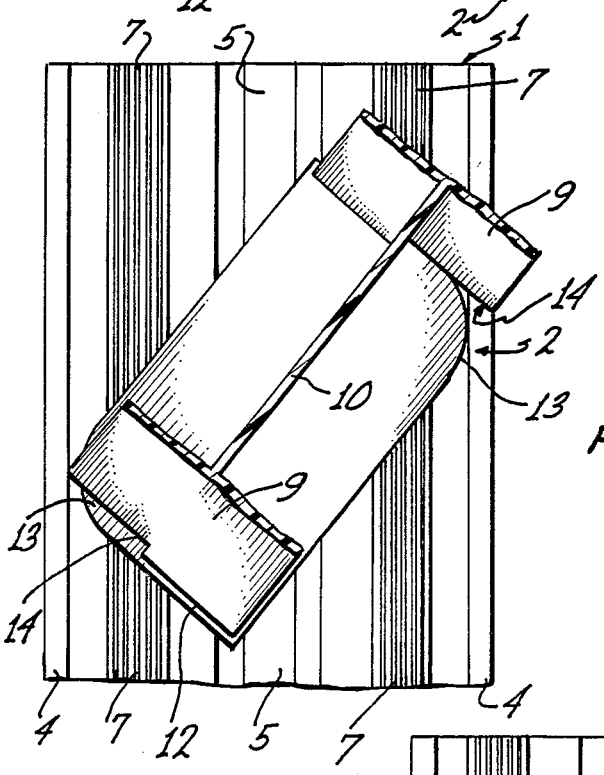
FIG. 2 is an elevational view in partial section showing a first step in attachment of the bracket of FIG. 1 to a support member of the invention.
Figure 3:
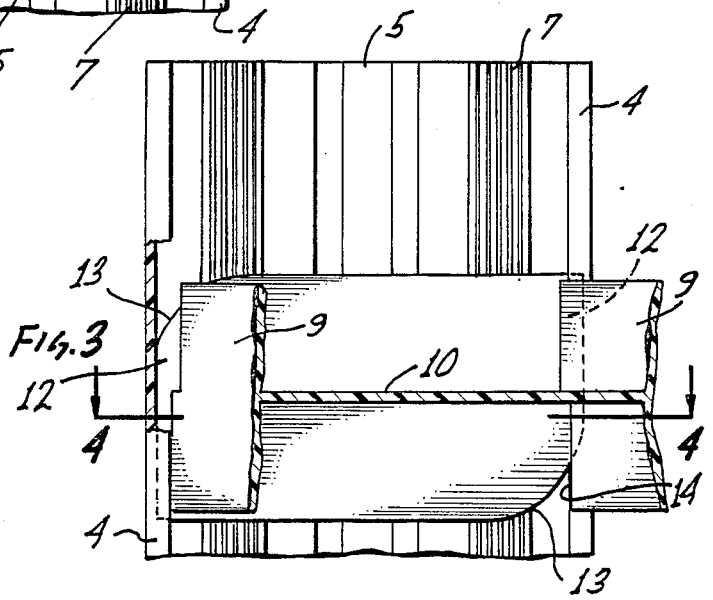
FIG. 3 is a view similar to FIG. 2 showing the bracket of FIG. 1 in its final position as attached to the support member.
Figure 4:
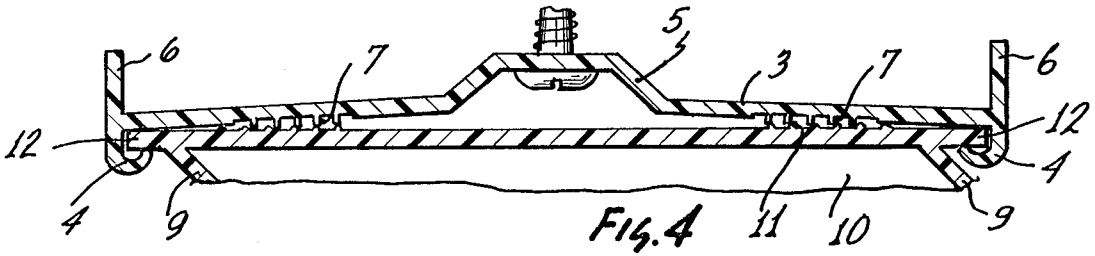
FIG. 4 is a fragmentary plan view in section about the line 4—4 of FIG. 3.

In the improvements of this invention in FIGS. 2 and 3 the support member 1 is seen looking directly at it when mounted on a wall, a post or other vertical surface and in FIG. 4 it is shown in a plan view in section. The support member 1 has a backplate 3 having a lip 4 on either end. The lips 4 curl forward from the backplate 3 to form opposing channel or grooves. Located in the center of the backplate 3 of the support plate 1 is a mounting channel 5.

The channel 5 is sized and shaped such that a screw or other attaching implement can be driven through the back of the channel 5 and into a support surface as, for instance a wall, post or the like to provide for attachment of the support member 1 to the wall, post or other surface. Since the channel 5 is recessed with respect to the plane of the backplate 3 the head of the screw or other fastener can be recessed within the channel 5 and not interfere with attachment of the brackets 2 onto the support member 1.

Flanges 6 extend along the back edges of the backplate 3. The flanges 6 are of a depth of about the same depth as the channel 5 such that when the support member 1 is attached to a surface, it is supported in its center by the back of the channel 5 and along its edges by the flanges 6.

A plurality of ridges 7 are formed on the left and right sides of the front of the backplate 3. These ridges form an interference fit with similar ridges on the bracket 2 holding the bracket 2 against vertical movement on the support member 1.

As is evident from viewing FIG. 4 the support member 1 can easily be formed utilizing extrusion or other molding techniques. If formed as an extrusion it can be formed as a continuous extrusion and cut off into proper lengths. As can be seen in FIGS. 2 and 3 the support member 1 is attached to a vertical surface as a long strip. The strips can extend from floor to ceiling when mounted on a wall or they can be shorter if mounted on a post or other support surface. In any event the length of the support member 1 can be chosen such that it can custom fit the entire height of a wall, post or other surface on which the support member 1 is attached.

The improved bracket member 2 of this invention is shown isolated in FIG. 1 and shown being attached to the support member 1 in FIG. 2 and as attached to the support member in FIGS. 3 and 4. The bracket 2 is formed of a backplate 8 which has left and right side flanges 9 which extend from the backplate 8. A web 10 intersects with and is integrally formed with the flanges 9 on the bracket 2. As so formed a portion of each of the flanges 9 extends above and below the web 10. That portion of the flanges 9 extending above the web 10 serve to hold an upper video tape container on top of the bracket 2 and that portion of the flanges 9 extending below the web 10 serve to hold and position a video tape container on an identical bracket which is positioned below the identified bracket along the length of a support member 1.

The bracket 2 of FIGS. 1 through 4 is constructed such that the flanges 9 and the web 10 intersect or project from the backplate 8 at an angle as, for instance a forty-five degree angle. The allows for displaying a greater area of the front or back surface of a video tape container to expose more of the front and back surface of the video tape container to the consumer.

A plurality of ridges are formed on the left and right sides of the backplate 8 of the bracket 2 as is evident in FIG. 4. The spacing of the ridges 11 on the backplate 8 of the bracket 2 is slightly offset with respect to the spacing of the ridges 7 on the support member 1 such that there will always be an interference fit between some of the ridges on the bracket 2 with respect to some of the ridges on the support member 1.

The width of the backplate 8 on the bracket 2 is chosen such that it fits across the width of the support member 1 underneath the lips 4 on the edges of the support member 1. The flanges 9 are formed on the backplate 8 of the bracket 2 such that an edge 12 is formed outwardly from each of the flanges 9 on the backplate 8. It is this edge 12 which is positionable underneath the lips 4 (in the channel or groove formed by the lips) of the support member 1 to hold the bracket 2 to the support member 1.

The backplate 8 of the bracket 2 is radiused on opposite corners. This is evident in FIGS. 1, 2 and 3 where it can be seen that the upper left hand and lower right hand corners of the bracket 2 are molded to have a radius 13 thereon. The area of the flanges 9 immediately adjacent these areas 13 are cut away to form notches 14.

Once the support member 1 is attached to a wall, post or other surface the brackets 2 are easily attached to the support member 1 by positioning the bracket on the support member at an angle as is seen in FIG. 2. This locates the radius areas 13 on the backplate 8 of the bracket 2 adjacent to the lips 4 on the support plate 1. The bracket 2 is then rotated or twisted clockwise to the position seen in FIG. 3. This positions the edges 12 on the backplate 8 on the bracket 2 underneath the lips 4 of the support member locking the bracket 2 to the support member 1. The ridges 11 on the backplate 8 of the bracket 2 interlock with the ridges 7 on the front of the backplate 3 of the support member to firmly and fixedly hold the bracket 2 to the support member 1. The interlocking of these ridges can best be seen in FIG. 4.

The radiusing at 13 of the backplate 8 of the bracket 2 allows for twisting of the bracket 2 from the position seen in FIG. 2 to the position seen in FIG. 3 to mount the bracket 2 to the support member. The bracket 2 can be easily removed from the support member 1 by simply rotating it counterclockwise, that is from the position seen in FIG. 3 to the position seen in FIG. 2.

The bracket 2 is positioned generally in the desired position along the support member 1 in an orientation seen in FIG. 2 and then rotated to the orientation seen in FIG. 3. The bracket once locked onto the support member 1 as seen in FIG. 3 can be slid upwardly and downwardly against the friction fit of the ridges 11 against the ridges 7 by applying pressure to the bracket 2 to slide it along the support member 1. Normally the bracket 2 would generally be positioned on the support member 1 and then rotated from FIG. 2 to FIG. 3 to lock it and then a fine adjustment would be made by sliding the bracket a small distance along the support member 1.

Figure 5:
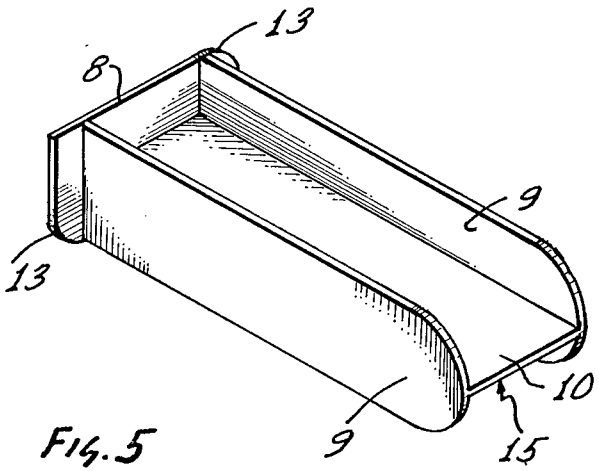
FIG. 5 is an isometric view of a further bracket of the invention.

In FIG. 5 a further bracket 15 is illustrated. This bracket 15 differs from the bracket 2 only in the orientation of its flanges 9 and web 10 with respect to its backplate 8. Instead of being located at an acute angle as was the bracket 2 the flanges 9 and web 10 of the bracket 15 are located at a 90 degree angle with respect to the backplate 8. The backplate 8, however, is sized and shaped exactly as per the backplate 3 of the bracket 2. Since the flanges 9 of the bracket 15 are not orientated at an acute angle with respect to the backplate 8 the edges 12 are located further out from the flanges 9 and as such if desired the notches 14 of the bracket 2 need not be used on the bracket 15.

Further shown on the bracket 15 is the positioning of the radius 13 on the lower left hand corner and the upper right hand corner. Thus, for illustrative purposes, in attaching the bracket 15 to a support member 1, the bracket 15 would be rotated counterclockwise to lock it on the support member and rotate clockwise to remove it from the support member.

Figure 6:
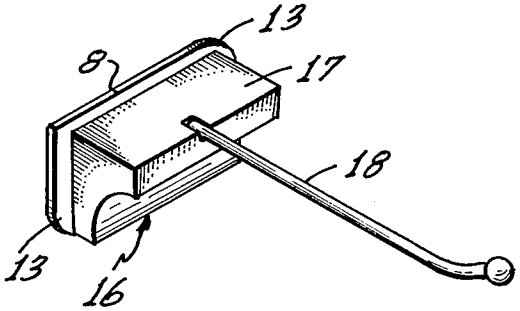
FIG. 6 is an isometric view of even a further bracket of the invention.

A further bracket 16 is shown in FIG. 6. It also includes a base plate 8 having radiuses 13 as per the prior brackets. It is mounted to a support member 1 in exactly the same manner as were the brackets 2 and 15. Positioned on the base plate 8 of the bracket 16 is a base 17 which supports a projection 18.

The bracket 16 is utilized in exactly the same manner as the prior brackets except it can be utilized to display other articles by hanging them on the projections 18.

What is claimed:

1. A display rack which comprises:

a support member;

a bracket;

said support member formed as an elongated element having left and right side lips and a plurality of ridges extending along the length of the elongated element;

said bracket member formed with a base plate having a plurality of ridges extending along the back of the base plate and left and right side edges sized and shaped to be positionable underneath the lips on said support members, diagonally opposing corners of said back plate of said bracket formed with radiuses thereon allowing for rotation of said backplate of said bracket underneath the lips on said support member;

said bracket further including means on said bracket for holding an article.

2. The display rack of claim 1 wherein:

said support member further includes an elongated channel formed on said support member for receiving an attaching implement for attaching said support member to a support surface.

3. The display rack of claim 1 wherein:

said ridges are formed in two groups on said support member, a first of said groups extending on the left hand side of said support member along the elongated dimension of said support member and the second of said groups extending on the right side of said support member along the elongated dimension of said support member; and said ridges on said bracket are formed in two groups with the first of said groups extending along the back of said bracket on the right side of said back of said bracket and the second of said groups extending on the back of said bracket along the left hand side of said bracket, said two groups of said ridges on said support member and said two groups of said ridges on said bracket positioned so as to interact with one another when said bracket is located on said support member.

4. The display rack of claim 1 wherein:

said bracket includes left and right side flanges and a web extending between said flanges.

5. The display rack of claim 4 wherein:

said flanges and said web extend at an angle from said the back plate of said bracket.

6. The display rack of claim 4 wherein:

said flanges and said web extend at 90 degrees from said backplate of said bracket.

7. The display rack of claim 1 wherein:

said bracket includes a support base and a projection member extending from said support base.

8. The display rack of claim 1 wherein:

said lips on said support member form inwardly directed channels and said edges on the backplate of said bracket fit into said channels.

9. A bracket for a display rack which comprises:

a backplate;

said backplate having parallel left and right side edges;

said backplate further having a top edge and a bottom edge connecting between said respective parallel left and right side edges and joining said parallel left and right sides at top right and top left and bottom right and bottom left corners respectively;

one of said top right or top left corners where the top edge intersects one of said parallel side edges and one of said bottom right or bottom left corners where the bottom edge intersects one of said parallel side edges each being rounded in shape, said one of said top corners which is rounded and said one of said bottom corners which is rounded being diagonally opposed from each other on said backplate.

10. A bracket of claim 9 wherein:

the other of the corners wherein said top edge and said bottom edge intersect said parallel side edges each formed as essentially 90 degree angles.

11. A bracket of claim 9 wherein:

said bracket includes left and right side flanges and a web extending between said flanges.

12. A bracket of claim 11 wherein:

said flanges and said web extend at an angle from said of said bracket.

13. A bracket of claim 11 wherein:

said flanges and said web extend at 90 degrees from said backplate of said bracket.

14. A bracket of claim 9 wherein:

said bracket includes a support base and a projection member extending from said support base.

15. A bracket of claim 12 including:

said flanges being spaced away from said backplate adjacent said rounded corners to form a notch between said flanges and said backplate adjacent to said rounded corners.

16. A bracket for a display rack which comprises:

a backplate;

said backplate having parallel left and right side edges;

said backplate further having a top edge and a bottom edge connecting between said respective left and right side edges and joining said left and right sides at top right and top left and bottom right and bottom left corners respectively;

one of the top corners where the top edge intersects one of the side edges and one of the bottom corners where the bottom edge intersects one of the side edges each being rounded in shape, said one of said top corners and said one of said bottom corners being diagonally opposed from each other on said backplate; and the other of the corners wherein said top edge and said bottom edge intersect said side edges each formed as essentially 90 degree angles.

17. A bracket of claim 16 wherein:

said bracket includes left and right side flanges and a web extending between said flanges.

18. A bracket of claim 16 wherein:

said bracket includes a support base and a projection member extending from said support base.

19. A bracket of claim 17 wherein:

said flanges being spaced away from said backplate adjacent said rounded corners to form a notch between said flanges and said backplate adjacent to said rounded corners.

20. A bracket for a display rack which comprises:

a backplate;

said backplate having parallel left and right side edges;

a top edge and a bottom edge connecting between said respective left and right side edges and joining said left and right sides at top right and top left and bottom right and bottom left corners respectively;

one of the top corners where the top edge intersects one of the side edges and one of the bottom corners where the bottom edge intersects one of the side edges each being rounded in shape, said one of said top corners and said one of said bottom corners being diagonally opposed from each other on said backplate;

said bracket including left and right side flanges and a web extending between said flanges;

said flanges and said web extending at an angle from said backplate of said bracket; and said flanges being spaced away from said backplate adjacent said rounded corners to form a notch between said flanges and said backplate adjacent to said rounded corners.

* * * * *

UNITED STATES PATENT AND TRADEMARK OFFICE

CERTIFICATE OF CORRECTION

PATENT NO. : 4,846,354

DATED : JULY 11, 1989

INVENTOR(S) : DUDLEY D. ADAMS

It is certified that error appears in the above-identified patent and that said Letters Patent is hereby corrected as shown below:

Column 5, line 35, "rotate" should be --rotated--.

Column 6, line 64, insert --backplate-- before "of said bracket".

Signed and Sealed this

Sixteenth Day of October, 1990

*Attest:*

HARRY F. MANBECK, JR.

*Attesting Officer*

*Commissioner of Patents and Trademarks*